United States Patent [19]

Schuman

[11] 3,973,771

[45] Aug. 10, 1976

[54] ILLUSION AMUSEMENT DEVICE

[76] Inventor: Mark Schuman, 101 G St., SW. Apt. No. 516, Washington, D.C. 20024

[22] Filed: Sept. 3, 1974

[21] Appl. No.: 502,748

Related U.S. Application Data

[63] Continuation-in-part of Ser. No. 408,288, Oct. 23, 1973, Pat. No. 3,902,263.

[52] U.S. Cl. ..... 272/8 R; 35/19 R; 40/106.21; 60/407; 60/533

[51] Int. Cl.[2] ..... A63J 23/00

[58] Field of Search ..... 272/8 R, 8 D, 8 N, 27 B, 272/27 N, 27 W; 35/19 R; 46/53, 56, 57, 55, 58, 41, 124; 40/37, 39, 40, 106.3, 106.21, 106.22; 417/207; 60/325, 370, 407, 412, 533, 537, 542

[56] References Cited

UNITED STATES PATENTS

| | | | |
|---|---|---|---|
| 1,647,902 | 11/1927 | Cohn | 46/56 |
| 1,782,555 | 11/1930 | Weinstein | 46/56 |
| 2,425,212 | 8/1947 | Strumor | 46/56 |
| 2,748,528 | 6/1956 | Wolf | 46/56 X |
| 3,009,273 | 11/1961 | Gessmann | 40/39 |
| 3,477,723 | 11/1969 | Djedda | 46/41 X |

FOREIGN PATENTS OR APPLICATIONS

| | | | |
|---|---|---|---|
| 1,409,859 | 7/1965 | France | 40/106.21 |
| 345,223 | 12/1921 | Germany | 46/56 |
| 832,113 | 2/1952 | Germany | 46/41 |
| 123,620 | 3/1919 | United Kingdom | 46/56 |

*Primary Examiner*—Richard C. Pinkham
*Assistant Examiner*—Arnold W. Kramer
*Attorney, Agent, or Firm*—Lowe, King, Price & Markva

[57] ABSTRACT

A passageway forming a nozzle supplies a positive pressure impulse, derived from an oscillatory pressure source, to blades of a turbine mounted in a chamber. The passageway conducts fluid in a direction from the source toward blades of the turbine during a first portion of the oscillatory cycle while the pressure of the source exceeds the pressure of the fluid proximate the turbine. The fluid is directed by the nozzle in a concentrated stream toward the blades. During a second portion of the cycle while the source pressure is less than the fluid pressure proximate the turbine, fluid diffusely flows in the chamber away from proximate the turbine toward the source. The diffusely drawn fluid produces a negative pressure impulse on the turbine. The negative pressure impulse is substantially weaker than the positive impulse, whereby a net positive torque is exerted on the turbine to continuously drive the turbine in a positive rotational direction. The chamber confines the fluid substantially to a region within and proximate the turbine and channels the fluid in the direction the turbine is rotating to conserve the rotational inertia and rotational energy of the fluid and turbine, whereby the angular velocity of the turbine is augmented. The passageway appears to be directed along the axis of symmetry but, actually, the passageway is angled off center and thus the turbine will be rotated. The nozzle and oscillatory pressure source can also be used to induce and sustain a substantial rotational or circuitous motion of a small free object in the chamber.

47 Claims, 1 Drawing Figure

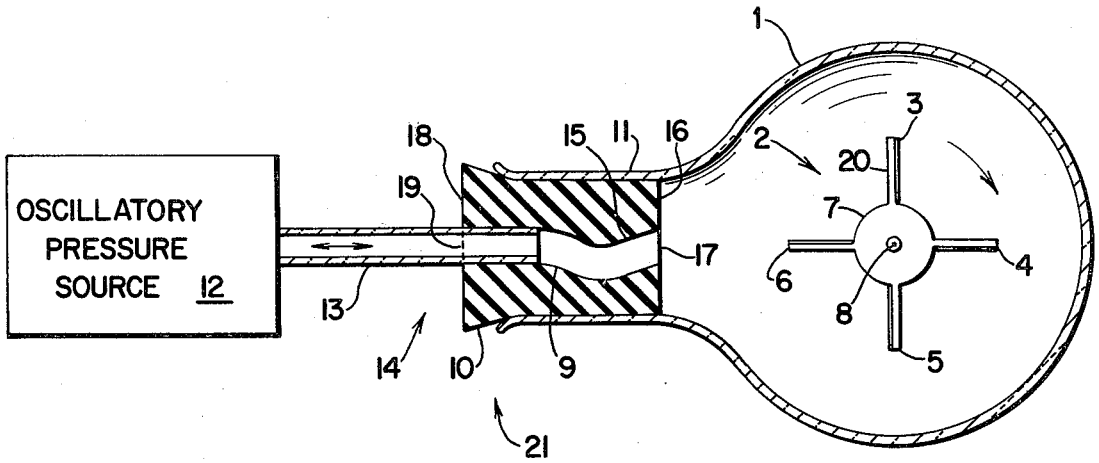
OSCILLATORY
PRESSURE
SOURCE 12
1
2
3
4
5
6
7
8
9
10
11
13
14
15
16
17
18
19
20
21

ILLUSION AMUSEMENT DEVICE

RELATIONSHIP WITH COPENDING APPLICATION

The present application is a continuation-in-part of my copending application entitled Thermally Driven Device Utilizable for Novelty, Demonstration and/or Display Purposes, Ser. No. 408,288, filed Oct. 23, 1973, and now U.S. Pat. No. 3,902,263.

FIELD OF THE INVENTION

The present invention relates to apparatus wherein an oscillatory pressure source induces motion of an object. The present invention also relates to apparatus wherein fluid flow induces rotary or circuitous motion of an object or a fluid, wherein the object or fluid generally is in a chamber. More specifically, the invention relates to apparatus wherein an oscillatory pressure source, such as a thermally driven oscillatory free piston apparatus, drives a turbine without the use of check valves. This invention also relates to novelty, display, or physics demonstration devices utilizing fluid flow or rotary motion.

BACKGROUND OF THE INVENTION

Typically, turbines are driven by a relatively continuous source of pressurized or rapidly moving fluid. For example, hydraulic turbines usually, if not always, are driven by a substantially continuous stream of water which descends through a certain elevation or "head"; a turbine of an aircraft turbojet engine is driven by a substantially continuous stream of air which is pressurized by a continuously rotating compressor and by continuous combustion of a fuel added to the pressurized air.

In both of these devices, incoming fluid is supplied substantially continuously. Aa fluid inlet is provided for the incoming fluid and an outlet, separate from the inlet, is provided for exhausting the fluid after the fluid has supplied energy to the rotating turbine. Thus the fluid is unidirectionally supplied to the turbine through an inlet means and unidirectionally exhausted from the turbine through an outlet means separate from the inlet means.

In my previously mentioned copending application, Ser. No. 408,288, there is disclosed a device wherein rotary or circuitous motion of an object is induced in a chamber in response to fluid flow in the chamber resulting from a source of oscillatory fluid pressure being connected to the chamber via only a single port or passageway which serves both as an inlet and outlet. The apparatus disclosed in Ser. No. 408,288 is a relatively inefficient, thermally driven oscillating free piston apparatus having a minimum number of moving parts; the apparatus develops an oscillatory pressure variation in a rebound chamber and has certain advantages for use, inter alia, as a novelty lamp or as a display or physics demonstration device. The rebound chamber contains an object that undergoes motion having a rotational component that is induced by the oscillatory flow of fluid in the rebound chamber. Generally, the object has an unpredictable path and cannot do useful work.

Rotary turbine compressors, such as mentioned above, are inefficient in small sizes, more so than piston compressors. Also, turbine type energy converters, such as turbo-generators, are noisy unless operated in a closed cycle, which reduces their efficiency, whereas certain piston compressors or piston type energy converters, such as those of the Ericsson or Stirling cycle type, are quiet. However, piston compressors typically require check valves to produce a continuous supply of pressurized fluid for driving a turbine. Check valves can affect the life, as well as the efficiency, of such compressors.

It is known that a lightweight object, such as a table tennis ball, can be supported by a steady stream of air directed upwards in a substantially vertical direction. The air stream exerts a driving and stabilizing force on the ball as a result of fluid pressure. The object remains approximately on the mean flow axis of the stream as a resultt of differential fluid pressure on the ball in accordance with the Bernouli effect, and is positioned in height approximately at a point where the net upward force of the air stream on the object is equal to the gravitational force exerted on the object.

BRIEF DESCRIPTION OF THE INVENTION

According to the present invention, an object is driven in response to an oscillatory flow of compressible or incompressible fluid coupled to it through a passageway or nozzle that is responsive to a variable pressure source of the fluid. The fluid flows alternately from the source, through the nozzle to a region beyond the nose of the nozzle when the source pressure exceeds the pressure in the region beyond the nose, and from the region back through the nozzle to the source when the pressure of the source is less than the pressure in the region. Because of the nozzle effect, the fluid flow leaving the nozzle and flowing into the region beyond the nozzle nose while the source pressure exceeds the pressure in the region is directed by the nozzle primarily in a narrow concentrated stream into the region. In contrast, the fluid flowing from the region back through the nozzle to the source while the source pressure is less than the pressure in the region is drawn relatively diffusely from the region proximate the nozzle nose because the nozzle is essentially reversed in direction.

Any stationary or slowly moving object or fluid in the path of the stream slows or deflects the fluid stream as a result of: (1) fluid drag against the object or fluid in the path of the stream, (2) deflection of the stream by surfaces of the object in the path, and (3) inertia of the object or fluid in the path of the stream. This slowing or deflecting of the fluid stream causes a pressure or pressure impulse to be exerted by the fluid stream on the object or fluid in the path of the stream. This pressure impulse tends to drive or sweep the object in a general direction away from the nozzle tip. However, the specific direction of the driving force on the object is affected by the shape of the object and the position and orientation of the object with respect to the fluid stream. The pressure of the fluid stream tends to sweep or drive the fluid in its path in approximately the same direction as that of the fluid stream, which at least initially is in line with the mean flow axis of the passageway or nozzle near the tip or nose of the passageway or nozzle and directed away from the tip or nose.

When the fluid is being drawn diffusely from the region proximate the nozzle tip, the diffuse current causes a driving or sweeping force on an object or fluid in the region resulting from an interaction of the object or fluid with the drawn fluid. This interaction is similar to the interaction of the object or fluid in the path of the fluid stream with the fluid stream as described above, but in this case the driving or sweeping force has a general direction toward the nozzle nose because fluid is now being drawn into the nozzle from the region, rather than being forced from the nozzle into the region. Also, because the fluid is drawn from the region in a somewhat cone-shaped diffuse current which is broader and weaker at most any point than the above-mentioned stream of fluid ejected into the region, the driving or sweeping force on a small object, i.e., an object smaller than the cross-section of the wide-angled cone of drawn fluid, is weaker than the driving force exerted on the object by the relatively narrow-angled cone of fluid directed by the nozzle in a narrow stream toward the object.

Therefore, with regard to exerting a driving pressure or driving force on an object in the region beyond the nozzle tip, the stream of fluid directed from the nozzle into the region while the source pressure is higher than the pressure in the region generally predominates over the diffuse current of fluid being drawn from the region into the nozzle while the source pressure is less than the pressure in the region. If the source is an oscillatory pump, the above predominance prevails even though the total amount or mass of oscillatory fluid flowing into the region via the nozzle during the portion of the cycle while the pump pressure exceeds the pressure in the region is approximately equal to the amount or mass of oscillatory fluid flowing from the region to the source via the nozzle while the pump pressure is less than the pressure in the region. The total mass flow during the two portions of the cycle are equal although the flow in the region is concentrated in a stream during the first cycle portion and diffuse during the second. The above-mentioned predominance of the driving force or driving effect of the stream over the driving force or driving effect of the diffuse current is especially strong when the object is properly dimensioned with respect to the dimensions of the stream cross-section, e.g., when the cross-sections of the stream and object are similar in size and shape.

Because of this predominance of the ejected stream over the diffusely drawn current, the oscillatory flow through the nozzle can be used to exert a net pressure on, or differential pressure across, an object by the fluid for purposes such as to support the weight of the object on the oscillatory stream of fluid. It can also be used to induce circuital or rotational motion of an object, as by driving a turbine.

Even it there is no object in the region proximate the nozzle tip, the concentrated, substantially unidirectional stream still predominates over the somewhat multi-directional, diffuse current, with regard to the directional driving effect on the fluid in the region and causes a fluid flow component having a somewhat doughnut or mushroom shaped flow pattern in the region. The stream is directed through the hole in the doughnut or constitutes the stem of the mushroom. A small object in the region tends to follow such a flow pattern whereby it can undergo substantially circuitous or rotational motion.

If the region is enclosed by a chamber, whereby the chamber is connected to the source via the nozzle, the fluid and any such object are confined and channeled by the chamber, thereby augmenting or producing rotational or circuitous circulation or motion of the fluid and object. The diffuse drawing of fluid during a portion of the cycle retards such rotational or circuitous motion only slightly. The object moves in response to pressure of differential pressure of the moving fluid on the object. The fluid pressure exerted on the object may arise from fluid drag or from a fluid pressure impulse arising from deflection of the stream by the object. If the chamber is spherical and the nozzle is directed toward the center of the chamber, rather than off-axis, the flow pattern is somewhat mushroom or doughnut shaped, and a free movable object in the chamber would tend to be affected accordingly. If the nozzle is directed off-axis, the flow tends to be more rotational about a substantially single common axis and can be used for driving a turbine. The turbine axis would preferably be positioned coincident with the single common axis of rotation of the fluid. If the chamber is symmetric about a point or line, these axes normally or preferably pass through the point or coincide with the line. The point or line is sometimes referred to as a center or axis of symmetry of the chamber, respectively.

Because of the inertia of the fluid or object, the rotational or circuitous motion is in general sustained over a complete cycle of oscillatory pressure variation or flow. Assuming the flow has sufficient amplitude and alternates in direction sufficiently frequently, it is not necessary that the variable pressure source be periodic, or even cyclical in the sense of equal mass flows in and out of the nozzle tip each "cycle." For example, if the variable pressure source were a hypothetical random pump which produces pressure variations of an at least partially random nature, the alternate mass flows in and out would not generally be equal. However, assuming that the random pump communicates solely with the nozzle, the net mass flow directed out of the nozzle toward the object would, when measured cumulatively over a large number of alternations, be essentially equal to the net mass flow drawn into the nozzle from the object region toward the source. The device constitutes an illusion amusement device by providing an at least partially hidden, angled portion in a passageway between the oscillatory pressure source and the turbine blades. The external portions of the passageway appear to an observer to be concentric with the apparent axis of a body in which the passageway is formed so that the fluid appears to be directed toward and away from an axis of the turbine and thereby incapable of producing a net positive torque on the turbine. In actuality, however, the hidden, angled passageway portion has a mean flow axis at a substantial angle with the apparent mean axis of the passageway for directing the positive pressure variations of the oscillatory source toward the faces of the blades at a finite distance from the rotor axis. Thereby, a net positive torque is applied to the turbine to rotate the blades, even though an observer might not believe this to be possible.

It is, accordingly, an object of the present invention to provide a new and improved apparatus wherein fluid pressure induces motion of an object.

A further object of the invention is to provide a new and improved apparatus wherein a source of oscillatory fluid pressure repeatedly exerts a net fluid force on, a net torque on, or a differential pressure across, an object immersed in a fluid, wherein the force, torque, or differential pressure retains a substantial net value when integrated or averaged over the oscillatory cycle.

An additional object of the invention is to "rectify", without utilizing check valves, a source of variable fluid pressure.

Another object of the invention is to provide a new and improved apparatus wherein an oscillatory fluid pump communicating with a fluid medium repeatedly subjects a surface portion immersed in the fluid medium to a higher pressure averaged over the oscillatory cycle than the pressure of the fluid medium averaged over the oscillatory cycle.

A still further object of the present invention is to provide a new and improved apparatus wherein a net driving force is repeatedly exerted on an object by connecting, without check valves, an oscillatory pressure source to a nozzle directed toward the object.

An additional object of the invention is to provide a new and improved apparatus wherein a source of oscillatory pressure variation induces rotational or circuitous motion of an object in a chamber without requiring a valve between the source and chamber.

A further object of the invention is to provide a new and improved apparatus wherein a thermally driven free piston pump drives a small turbine.

Still another object of the invention is to provide a new and improved novelty, display, or physics demonstration device.

An additional object of the present invention is to provide a new and curiosity provoking feature for a free piston novelty lamp, wherein heat and light from the electric bulb of the lamp provide sufficient heat energy for sustaining oscillation of one or more free pistons which in turn sustain rotation of one or more miniature turbines.

A further object of the invention is to provide a new and improved apparatus for inducing rotational or circuital motion of a fluid or object in a chamber in response to variations in pressure of a fluid pressure source which communicates with the chamber via a single passageway.

The above and still further objects, features and advantages of the present invention will become apparent upon consideration of the following detailed description of one specific embodiment thereof, especially when taken in conjunction with the accompanying drawing.

BRIEF DESCRIPTION OF THE DRAWING

The sole FIGURE is an illustration of one embodiment of the present invention, comprising a chamber containing a rotating turbine which is driven by an oscillatory pump connected directly to the chamber via a single passageway.

DETAILED DESCRIPTION OF THE DRAWING

Reference is now made to the sole FIGURE, wherein there is illustrated a closed chamber or flask 1 containing a small turbine or bladed wheel 2 including mutually orthogonal blades 3, 4, 5, and 6 spaced apart at equal ninety degree intervals and affixed radially to rotor 7 at a finite distance from rotor and turbine axis 8. Blades 3–6 are substantially flat or planar. Rotor 7 rotates about rotor and turbine axis 8 in response to an alternating flow of fluid conducted into and out of chamber 1 via hole 9 in rubber stopper 10. Rubber stopper 10 is inserted into neck 11 of flask 1.

A source of fluid pressure variation 12, which can be an oscillatory pump, is connected to hole 9 by tube 13 which is inserted a short distance into hole 9 in stopper 10 near the end of hole 9 most remote from turbine 2, to provide a good seal with stopper 10. Tube 13 and hole 9 form a single passageway 14 by which source 12 is connected in a fluid flow relationship with chamber 1 and turbine 2, whereby fluid is alternately and perhaps periodically conducted from the source to the chamber via passageway 14 during time portions when the source pressure exceeds the pressure in the chamber and from the chamber to the source via the passageway during time portions when the pressure of the source is less than the pressure in the chamber. In one embodiment, the pressure variations of source 12 have a frequency on the order of 10 Hertz. The fluid can be an invisible fluid, such as air, especially for novelty, display, or demonstration device applications. For energy conversion applications, more efficient working fluids are available.

Passageway 14 and hole 9 have an angled bore portion 15 proximate face 16 of stopper 10. Face 16 is the stopper face which is most proximate to, and faces, turbine 2. Bore portion 15 begins at port 17 in face 16 of stopper 10 and extends a short distance into the stopper. Port 17 is centered with respect to face 16, as is tube 13 with respect to the opposite face 18 of the stopper where tube 13 enters the stopper via the remote end 19 of hole 9, whereby passageway 14 appears to an observer to be concentric with the apparent axis of symmetry of stopper 10 and neck 11. However, bore portion 15 has a mean flow axis which is oriented at a substantial angle with respect to the apparent axis of symmetry of a passageway means or connecting means 21, which connects the source 12 in a fluid flow relationship with the chamber 1 and the turbine 2. Connecting means 21 includes neck 11, stopper 10, and passageway 14. To the observer, the apparent axis of symmetry of passageway means 21 is a straight line coincident with the axis of tube 13 and passing through the center or centroid of port 17 in the stopper face 16; the passageway means axis of symmetry also passes approximately through the center of chamber 1 and intersects the axis 8 of the rotor 7 or turbine 2. Turbine 2 is located approximately at the center of chamber 1 and its axis 8 passes through the center or center of symmetry of the chamber. Thus the chamber 1 and passageway means 21 have an apparent axis of symmetry and the alternating flow appears to be directed along the axis of symmetry and alternately toward and away from the turbine axis 8, which would not explain to an observer the rotary motion of the turbine.

During the time portions when the pressure of source 12 is greater than the pressure in chamber 1, the fluid conducted into chamber 1 from source 12 is directed by the passageway 14 in a relatively narrow stream as a result of the nozzle effect of passageway 14, and in particular bore portion 15. Because bore portion 15 is angled upwards in the FIGURE at a substantial angle with respect to the axis of symmetry of the passageway means 21, which axis passes through the rotor axis 8, the fluid stream is directed above the rotor axis and toward the proximate face 20 of blade 3 which happens to instantaneously be above the rotor axis and approximately in line with bore portion 15. Thus the fluid stream impinges against and is deflected by blade face 20, thereby producing a pressure impulse against face 20, and therefore a differential pressure across blade 3, which tends to drive blade 3 and rotor 7 in the indicated clockwise direction, which arbitrarily may be considered as the positive rotational direction.

During the time portions when the pressure of source 12 is less than the pressure in chamber 1, fluid is drawn relatively diffusely from proximate the turbine 2, through port 17, bore portion 15, and the remainder of passageway 14 back to source 12. During these time portions of relatively low source pressure, the fluid is drawn from chamber 1 diffusely rather than in a concentrated or narrow stream, because the nozzle is essentially reversed in direction. Therefore, there is a small negative impulse on the turbine resulting primarily from deflection of the diffusely drawn fluid by the turbine blades, especially the blades above the turbine axis 8. This negative impulse is much smaller than the aforesaid positive impulse because the diffuse flow is spread out among the blades, whereby the impulse on one blade on one side of the rotor axis may cancel a similar impulse on the opposite side of the rotor axis, and also because some of the fluid drawn diffusely from the chamber does not intersect any blade of the turbine and thus is not substantially deflected. Thereby, a cycle of oscillation of pressure source 12 produces a net positive torque on turbine 2. Thus continuous operation of oscillatory source 12 sustains continuous rotation of the turbine. If a load (not shown) is connected to the turbine, useful work can be obtained, assuming a suitable design were used, which might include more than one passageway or nozzle. Passageway 14, as illustrated, serves as a crude nozzle.

Chamber 1 can be transparent to allow viewing of the turbine or other object inside the chamber. The shape of chamber 1, as illustrated, can be considered to be either substantially spherical or substantially a closed cylinder, as viewed from a closed end of the cylinder, although other shapes may also be used. The axis 8 of turbine 2 preferably approximately passes through the center of the sphere; in the case of a closed cylinder forming chamber 1, axis 8 is preferably coincident with the axis of the cylinder, to help conserve the rotational energy, and thereby augment the speed, of the fluid and the turbine. Chamber 1 confines the fluid and channels the directed or deflected stream into a rotational or circuitous path without causing wasteful fluid circulation. Spherical and cylindrical chambers having smooth walls minimize fluid drag on the fluid by the chamber walls, whereby the chamber conserves the rotational inertia and kinetic energy of the rotating fluid and turbine to augment the angular velocity of the turbine.

Other objects or a group of different fluids, e.g., immiscible liquids of different colors, can be induced to undergo rotational, circuital, or even partially random motion as a result of the pressure exerted on them by the circulating fluid, in combination with collisions with, or channeling by, the chamber walls, and gravity and thermal convection currents. The rotational or circuitous circulation of the fluid in the chamber is sustained because the directed narrow stream predominates over the fluid current in the chamber resulting from the diffuse drawing of fluid from the chamber. The chamber confines the fluid and channels the predominant stream into a substantially circuitous circulation path, whereby there is a circulation of the fluid having at least a substantial component which is substantially rotational or circuitous in the chamber. Actually, a suitable object could be made to traverse not only the chamber 1, but the passageway 14 and a chamber of the source as well. Generally such an object, to be susceptible to being induced by the fluid to undergo motion, should be lightweight, have low density, and/or have a high coefficient of fluid drag. The shape of the object and method of support, if is it is supported, are also factors which determine the susceptibility of the object to follow the motion of the circulating fluid. Examples of such an object are a small balloon and a small ball made of a light material with many air pockets, e.g., foam type packing material. In a macro sense, the bladed turbine can be considered as an object formed to have a high coefficient of fluid drag, whereby the turbine, in combination with its mounting structure, is highly susceptible to being rotated by off-axis or rotational fluid flow.

Since bore portion 15 is within stopper 10 and since bore portion 15 is partially hidden by turbine 2, it is difficult for an observer to see that the bore portion is angled with respect to the axis of symmetry of the passageway means. Thus the oscillatory flow appears to the observer to be along the apparent axis of symmetry of the passageway means, which axis intersects the rotor axis and the center or center of symmetry of chamber 1. Thereby, to the observer, the oscillatory flow appears incapable of exerting a net torque on the turbine over the oscillatory cycle. The apparent axis of symmetry, the turbine, and the chamber are oriented and positioned relative to each other so that the confining and channeling of the directed stream and the diffusely drawn current by the chamber do not destroy or interfere with this apparent incapability. Thus chamber 1 is symmetrically formed and is oriented and positioned relative to the passageway means axis of symmetry so that the confining and channeling of the directed fluid stream and the drawn fluid by the chamber walls do not destroy or interfere with this apparent incapability, e.g., do not appear to have any deflecting surface or assymmetry which would interact with the alternately conducted fluid to produce rotation of the fluid in the chamber about a single common axis. The sustained rotary motion of the turbine can thereby stimulate the curiosity of an observer, an advantage for use of the invention as a novelty lamp, display device, or physics demonstration device. Bore portion 15 can be made to havee a dark color to make its means flow axis even more difficult to see, in order to augment this scientific puzzle aspect.

Chamber 1 can double as a major portion of a rebound chamber of an oscillating piston apparatus. For example, chamber 1 containing turbine 2 can form the major portion of either of rebound chambers **3*a* or 3*b* of the oscillating free piston apparatus illustrated in FIG. 1 of my copending patent application, Ser. No. 408,288, which has curiosity provoking and features desirable for a novelty, display, or demonstration device application. The oscillating free piston pump described in the application provides an oscillatory flow sufficient to drive the turbine of the present invention. When utilized with such a free piston pump, chamber 1 provides sufficient rebound chamber volume to allow adequate motion of the free piston while helping to seal the fluid from the environment and facilitate development of an oscillatory pressure in the rebound chamber and efficient rebound of the free piston. The oscillatory pressure also facilitates positioning the free piston and synchronization of the two free pistons of Ser. No. 408,288. By channeling the fluid into a rotational path and conserving the rotational motion of the fluid and turbine, chamber 1 also helps to reduce the effective load of the turbine on the oscillatory pressure source for a given turbine speed and load. To obtain greater thermodynamic efficiency, for energy conversion applications, chamber 1 containing turbine 2** can be connected directly to a port in a cylinder side wall at one end of a cylinder bypass region of the free piston pumping devices described in my U.S. Pat. Nos. 3,782,859 and 3,767,325. Thus, in the energy conversion applications, chamber 1 is preferably connected to a pumping chamber of an oscillatory free piston pump utilizing a regenerative thermodynamic cycle; in the case of the novelty device, chamber 1 is preferably connected to, and forms a major portion of, a rebound chamber of a simpler but less efficient oscillating free piston apparatus utilizing a non-regenerative thermodynamic cycle. In either case, the free piston device is driven by means for alternately heating and cooling fluid within the device; in general, the working fluid consists of a compressible fluid. Chamber 1 helps seal the turbine, passageway, source, and working fluid from the environment, thereby helping to keep them free of dust and other particulate matter as well as avoiding dilution of the working fluid with air. Keeping dust and other particulate matter out of the system is especially important when the source is a free piston pump, since small particles can become trapped between a free piston and its cylinder, thereby stalling the piston and therefore the piston pump. While the above free piston devices have certain advantages, such as silent operation, long life, and either simplicity or high thermodynamic efficiency, it should be understood that the turbine can be driven by any suitable variable or oscillatory pressure source producing sufficient alternating flow.

A turbine with a single blade may be sufficient under certain circumstances to provide sustained turbine rotation. However, multiple blades on the turbine rotor generally augment the driving torque on the turbine and make the torque more uniform during the cycle of rotation, whereby the amplitude and uniformity of the angular velocity of the turbine are increased. Similarly, the amplitude and uniformity of the angular velocity of the turbine can be increased by using a multiplicity of passageways or nozzles similar to passageway or nozzle 14.

The fluid or object, such as a turbine or ball, to be driven by the circulating fluid, or on which a fluid force is to be exerted by the directed stream, may be considered as a load for the oscillatory source. If the source communicates with the load via a single passageway or nozzle, then each cycle all of the fluid conducted from the source to the load (or to the fluid region proximate or adjacent the load) passes through the passageway, and all of the fluid conducted from the load (or the load region) to the source passes through the passageway.

While there has been described and illustrated one specific embodiment of the invention, it will be clear that variations in the details of the embodiment specifically illustrated and described may be made without departing from the true spirit and scope of the invention as defined in the appended claims.

What is claimed is:

1. A turbine apparatus driven by a source of substantially oscillatory fluid pressure variation comprising a turbine including a rotor mounted to rotate about a rotor axis, a blade affixed to said rotor at a finite distance from said axis for receiving a pressure impulse from the fluid for rotating the rotor and blade about the rotor axis, passageway means for connecting said turbine in a fluid flow relationship with the source, said passageway means alternately conducting fluid in a direction from the source toward the turbine during a first portion of the oscillatory cycle while the pressure of the source exceeds the pressure of the fluid proximate the turbine and from proximate the turbine toward the source during a second portion of the cycle while the source pressure is less than the fluid pressure proximate the turbine, said passageway means being positioned and oriented so as to direct said conducted fluid from said passageway means in a stream toward a face of said blade during said first portion of the cycle so as to produce a positive pressure impulse on the blade upon deflection of the directed fluid by the face, said positive impulse producing a positive torque on said rotor and said turbine for driving the turbine in a positive direction of rotation about said axis, said conducted fluid during said second portion of the cycle being drawn substantially in a diffuse current from proximate the turbine into the passageway means, said diffuse fluid current producing a negative pressure impulse on the turbine, said negative pressure impulse being substantially weaker than said positive impulse, whereby a net positive torque on the turbine is derived from said alternate conduction of fluid, said net positive torque tending to drive the turbine in said positive rotational direction; wherein the turbine includes a multiplicity of blades functioning similarly to, and including, the first named blade, said blades being disposed approximately radially with respect to the axis of said rotor, said positive torque being augmented and made more uniform during the cycle of rotation as a result of said multiplicity of blades; wherein said passageway means has an apparent axis of symmetry which approximately intersects said rotor axis, said passageway means having a port in a face of said passageway means facing said rotor, the center of said port being approximately on said passageway means axis, said alternately conducted fluid flowing in alternate directions through said port, whereby said fluid appears to an observer to be directed along said passageway means axis toward and away from said rotor axis, said directed and drawn fluid appearing to the observer to be incapable of producing said net positive torque on the turbine; said passageway means having a passageway for alternately conducting said directed and said drawn fluid through said port, said passageway having a passageway portion proximate said port, said passageway portion being at least partially hidden from view by the observer by said passageway means, said passageway portion having a mean flow axis at a substantial angle with said apparent passageway means axis for directing said fluid toward said blade face at a finite distance from said rotor axis for providing said net positive torque so as to produce and sustain said positive rotation of said turbine in spite of said apparent incapability.

2. A turbine apparatus as in claim 1 further including a housing around said turbine, said housing confining said fluid substantially to a region within and proximate said turbine and for channeling said fluid in a substantially rotational path in said positive rotational direction; thereby conserving the rotational inertia and rotational energy of said fluid and said turbine, whereby the angular velocity of the turbine is augmented.

3. A turbine apparatus as in claim 2 wherein the inside surface of said housing is substantially spherical.

4. A turbine apparatus as in claim 2 wherein the inside surface of said housing is shaped to form a substantially closed cylinder.

5. A turbine apparatus as in claim 1 wherein said passageway portion forms a nozzle means for confining said directed fluid to a narrow stream during its travel from said passageway means toward said face.

6. A turbine apparatus as in claim 1 wherein said rotor and said blade are substantially enclosed by a housing, whereby said turbine and source are substantially sealed from the environment.

7. A turbine apparatus as in claim 6 wherein said housing is substantially transparent to allow viewing of said turbine.

8. A turbine apparatus as in claim 1 wherein said rotor, said blade, and said source are substantially enclosed by a housing, whereby said rotor, said blade, and said source are substantially sealed from the environment.

9. A turbine apparatus as in claim 1 further including a housing substantially enclosing the turbine and substantially sealing the turbine from the environment, said housing facilitating operation of the source and turbine.

10. A turbine apparatus as in claim 9 wherein said source includes an oscillating piston apparatus for inducing said oscillatory pressure variation within said housing.

11. A turbine apparatus as in claim 10 wherein said oscillating piston apparatus is a thermally driven oscillating free piston apparatus.

12. A turbine apparatus as in claim 11 wherein said fluid is a compressible fluid, and said passageway means connects said housing with a chamber of said oscillating free piston apparatus to form a rebound chamber for said oscillating piston apparatus, said rebound chamber including: the chamber, said passageway means, and the chamber formed by said housing containing the turbine.

13. A turbine apparatus as in claim 1 further including a thermally driven oscillating free piston apparatus for deriving said directed stream and said diffuse current.

14. A turbine apparatus as in claim 1 wherein the turbine is mounted in a chamber which is at least partially transparent.

15. A turbine apparatus as in claim 14 wherein said apparent axis of symmetry, said turbine, and said chamber are oriented and positioned relative to each other so that confining and channeling of said stream and said diffuse current by walls of said chamber do not destroy said apparent incapability.

16. A turbine apparatus as in claim 14 wherein the chamber is substantially spherical and the rotor axis passes approximately through the center of the chamber.

17. A turbine apparatus as in claim 14 wherein the chamber is symmetrically formed, and is oriented and positioned relative to said axis of symmetry, so that confining and channeling of said directed and drawn fluid by the chamber walls do not destroy said apparent incapability.

18. A turbine apparatus as in claim 1 wherein said connecting means for connecting said source with said turbine is formed so that substantially all of said fluid conducted from said source to said turbine passes through said port and substantially all of said fluid conducted from said turbine to said source passes through said port.

19. A turbine apparatus as in claim 18 wherein said passageway portion forms a nozzle.

20. A turbine apparatus as in claim 1 further including a source of substantially oscillatory pressure variation for deriving said directed stream and said diffuse drawing of fluid.

21. A turbine apparatus as in claim 1 further including an oscillatory pump for deriving said directed stream and said diffuse current.

22. A turbine apparatus as in claim 1 further including an oscillating piston apparatus for deriving said directed stream and said diffuse current.

23. A turbine apparatus as in claim 22 wherein the oscillating piston apparatus is an oscillating free piston apparatus.

24. A turbine apparatus as in claim 22 wherein the oscillating piston apparatus is a thermally driven, oscillating free piston apparatus.

25. The turbine apparatus of claim 1 wherein said passageway means includes vision obscuring means substantially surrounding said at least partially hidden passageway portion.

26. The turbine apparatus of claim 1 wherein said blades are approximately planar.

27. A device for producing motion of an object comprising a chamber, passageway means including a nozzle for connecting said chamber in a fluid flow relationship with a source of variable fluid pressure for alternately conducting fluid from said source through said nozzle into said chamber during a first set of time portions while the pressure of the fluid source exceeds the pressure of the fluid in the chamber and from said chamber through said nozzle to said source during a second set of time portions while the source pressure is less than said chamber pressure, the time portions of the first set occurring substantially alternately with the time portions of the second set, said conducted fluid being directed primarily in a narrow stream into said chamber by said nozzle during said first time portions, said conducted fluid being drawn substantially diffusely from said chamber through said nozzle during said second time portions, said fluid stream being directed into said chamber predominating over the diffuse fluid current in said chamber resulting from said diffuse drawing of fluid from said chamber, said chamber confining said fluid and channeling said predominant stream into a substantially circuitous path, whereby there is a circulation of the fluid having at least a substantial component which is substantially circuitous in the chamber; an object in the chamber, said object being susceptible to undergoing motion in response to pressure on the object by the circulating fluid, wherein said passageway means and said nozzle are constructed and oriented with respect to the chamber so that said nozzle appears to an observer to direct fluid approximately toward the approximate center of said chamber such that said alternate conduction of fluid through said nozzle appears to the observer to be incapable of causing the fluid in the chamber to substantially rotate about an axis passing approximately through the approximate center of the chamber, said nozzle having an internal bore portion proximate the end of the nozzle closest to the center of said chamber, said bore portion being angled with respect to said apparent direction so aa to direct said conducted fluid into the chamber at a substantial angle with respect to said apparent direction, said nozzle end being exposed and visible to an observer, means including the internal location of said bore portion for making the angular orientation of the angled bore portion substantially imperceptible to said observer; whereby said predominant stream passes a substantial distance away from said chamber center and induces and sustains substantial rotational motion of the fluid in the chamber about said axis in spite of said apparent incapability.

28. A device as in claim 27 wherein said chamber has a smooth internal wall surface, whereby conservation of the kinetic energy of the fluid and object in the chamber is increased and said kinetic energy is augmented.

29. A device as in claim 27 wherein said chamber has a substantially spherical internal wall surface, whereby fluid drag on said circulating fluid by said wall is relatively small.

30. A device as in claim 27 wherein said chamber is shaped to approximately form a closed cylinder, whereby fluid drag on said circulating fluid by said chamber is relatively small.

31. A device as in claim 27 wherein the object in said chamber has a density which is relatively low to augment the degree to which said object follows the circulation of the fluid in the chamber.

32. A device as in claim 27 wherein the object is formed to have a relatively high coefficient of fluid drag, whereby the degree to which the object follows the circulation of the fluid is augmented.

33. A device as in claim 27 wherein the object is formed so that it is susceptible to being induced by said circulating fluid to undergo rotational motion, wherein the nozzle appears to direct fluid in a direction which would appear to be incapable of inducing rotation of the object, said nozzle and said bore portion being oriented to induce said rotational motion of said object in spite of said apparent incapabilities, whereby said rotational motion of the object tends to provoke the curiosity of the observer.

34. A device as in claim 27 wherein said fluid is compressible and wherein said source includes an oscillating piston device having a rebound chamber, the chamber having the circulating fluid being connected to the source by said passageway means so that the chamber having the circulating fluid forms a portion of the rebound chamber of the source, whereby said circulating fluid chamber contributes to the rebound of a piston of said oscillating piston device.

35. A device as in claim 34 wherein said oscillating piston device is an oscillating free piston device which is driven primarily by means for alternately heating and cooling fluid within the oscillating free piston device.

36. A device as in claim 27 wherein substantially all of the fluid flowing from said source to said chamber passes through said nozzle, and substantially all of the fluid flowing from said chamber to said source also passes through said nozzle.

37. A device as in claim 27 wherein the object is a turbine mounted and positioned in the chamber so that said alternate conduction of fluid through said nozzle appears to be incapable of a net torque on the turbine, said turbine undergoing rotation in response to said alternate conduction and said rotational fluid motion in spite of said apparent incapabilities.

38. A device as in claim 37 wherein the blades of said turbine are substantially radially disposed with respect to the axis of rotation of said turbine as viewed from a position along said axis of said turbine.

39. A device as in claim 38 wherein said blades are approximately planar.

40. A device as in claim 37 wherein said blades are substantially flat.

41. A device as in claim 27 wherein the walls of said chamber are at least partially transparent to allow viewing of the motion of said object.

42. A device as in claim 27 wherein said source provides a substantially oscillatory pressure variation, whereby said alternate conduction is substantially cyclical.

43. A device as in claim 27 further including a source of variable fluid pressure for producing said alternate conduction.

44. A device as in claim 43 wherein said source comprises a substantially oscillatory pump.

45. A device as in claim 43 wherein said source comprises an oscillating free piston apparatus.

46. A device as in claim 27 wherein the object and chamber are formed so that said object undergoes motion which has at least a substantial component which is substantially circuitous in the chamber.

47. The device of claim 27 wherein the passageway means includes vision obscuring means substantially surrounding the angled bore portion.

* * * * *